US009656776B2

(12) United States Patent
Sloat et al.

(10) Patent No.: US 9,656,776 B2
(45) Date of Patent: May 23, 2017

(54) CONSTRUCT WITH STIFFENING FEATURES

(71) Applicant: Graphic Packaging International, Inc., Atlanta, GA (US)

(72) Inventors: Jeffrey T. Sloat, Broomfield, CO (US); Weston R. Wilson, Arvada, CO (US); Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/571,482

(22) Filed: Dec. 16, 2014

(65) Prior Publication Data

US 2015/0164252 A1 Jun. 18, 2015

Related U.S. Application Data

(60) Provisional application No. 61/963,866, filed on Dec. 16, 2013.

(51) Int. Cl.

| | |
|---|---|
| ***B65D 1/44*** | (2006.01) |
| ***B65D 1/40*** | (2006.01) |
| ***B65D 1/42*** | (2006.01) |
| ***B65D 1/36*** | (2006.01) |
| ***B65D 5/44*** | (2006.01) |
| ***B65D 1/34*** | (2006.01) |
| ***B65D 5/20*** | (2006.01) |

(52) U.S. Cl.

CPC ..... *B65D 1/44* (2013.01); *B65D 1/34* (2013.01); *B65D 1/36* (2013.01); *B65D 1/40* (2013.01); *B65D 1/42* (2013.01); *B65D 5/2019* (2013.01); *B65D 5/441* (2013.01); *B65D 5/443* (2013.01)

(58) Field of Classification Search

CPC ... B65D 1/34; B65D 1/36; B65D 1/42; B65D 1/44; B65D 1/40; B65D 5/441; B65D 5/443; B65D 5/2019

IPC ..... B65D 1/34,1/36, 1/42, 1/44, 1/40, B65D 5/441, 5/443, 5/2019

See application file for complete search history.

(56) References Cited

U.S. PATENT DOCUMENTS

| | | | | |
|---|---|---|---|---|
| 2,699,866 | A | 1/1955 | Russell | |
| 2,859,122 | A | 11/1958 | Maturi et al. | |
| 3,085,683 | A | 4/1963 | Harrison | |
| 3,086,691 | A * | 4/1963 | Fobiano | 229/195 |

(Continued)

FOREIGN PATENT DOCUMENTS

| | | |
|---|---|---|
| AU | 635667 | 3/1993 |
| CA | 1279902 | 2/1991 |

(Continued)

OTHER PUBLICATIONS

International Search Report and Written Opinion for PCT/US2014/070488 dated Apr. 20, 2015.

*Primary Examiner* — Eret McNichols

(74) *Attorney, Agent, or Firm* — Womble Carlyle Sandridge & Rice, LLP

(57) ABSTRACT

In general, one aspect of the disclosure is generally directed to a construct for supporting at least one article. The construct can comprise at least a panel and a plurality of stiffening features. The plurality of stiffening features can comprise a pattern of bosses formed in the panel. The pattern of bosses can be configured for at least partially reducing buckling of the panel.

43 Claims, 10 Drawing Sheets

(56) References Cited

U.S. PATENT DOCUMENTS

| | | | | |
|---|---|---|---|---|
| 3,200,944 | A | 8/1965 | Rapata | |
| 3,224,576 | A | 12/1965 | Whiteford | |
| 3,227,272 | A | 1/1966 | Critzer | |
| 3,351,264 | A | 11/1967 | Bostrom | |
| 3,443,685 | A | 5/1969 | Wanderer | |
| 3,601,253 | A | 8/1971 | Poupitch | |
| 3,708,086 | A | 1/1973 | Colato | |
| 3,965,323 | A | 6/1976 | Forker, Jr. et al. | |
| 4,175,483 | A | 11/1979 | Clark | |
| 4,349,124 | A * | 9/1982 | Faller | B65D 1/44 220/608 |
| 4,373,636 | A * | 2/1983 | Hoffman | B65D 1/34 206/545 |
| 4,593,818 | A | 6/1986 | Schenkman | |
| 4,606,496 | A | 8/1986 | Marx et al. | |
| 4,609,140 | A | 9/1986 | Van Handel et al. | |
| 4,638,941 | A | 1/1987 | Watson | |
| 4,712,676 | A | 12/1987 | Randall | |
| 4,721,499 | A | 1/1988 | Marx et al. | |
| 4,721,500 | A | 1/1988 | Van Handel et al. | |
| 4,739,884 | A | 4/1988 | Duplessy | |
| 4,775,771 | A | 10/1988 | Pawlowski | |
| 4,777,053 | A | 10/1988 | Tobelmann et al. | |
| 4,794,005 | A | 12/1988 | Swiontek | |
| 4,801,080 | A * | 1/1989 | Spengler | 229/125.19 |
| 4,831,224 | A | 5/1989 | Keefer | |
| 4,832,676 | A | 5/1989 | Johns et al. | |
| 4,848,573 | A | 7/1989 | Salacuse | |
| 4,862,791 | A | 9/1989 | Baughey | |
| 4,865,921 | A | 9/1989 | Hollenberg | |
| 4,866,234 | A | 9/1989 | Keefer | |
| 4,870,233 | A | 9/1989 | McDonald et al. | |
| 4,888,459 | A | 12/1989 | Keefer | |
| 4,896,774 | A | 1/1990 | Hammett et al. | |
| 4,916,280 | A | 4/1990 | Havette | |
| 4,936,935 | A | 6/1990 | Beckett | |
| 4,963,424 | A | 10/1990 | Beckett | |
| 5,026,958 | A | 6/1991 | Palacios | |
| 5,093,364 | A | 3/1992 | Richards | |
| 5,117,078 | A | 5/1992 | Beckett | |
| 5,213,902 | A | 5/1993 | Beckett | |
| 5,217,768 | A | 6/1993 | Walters et al. | |
| 5,221,419 | A | 6/1993 | Beckett | |
| 5,246,113 | A | 9/1993 | Schuster | |
| 5,260,537 | A | 11/1993 | Beckett | |
| 5,266,386 | A | 11/1993 | Beckett | |
| 5,298,708 | A | 3/1994 | Babu et al. | |
| 5,310,977 | A | 5/1994 | Stenkamp et al. | |
| 5,310,980 | A | 5/1994 | Beckett | |
| 5,317,118 | A | 5/1994 | Brandberg et al. | |
| RE34,683 | E | 8/1994 | Maynard et al. | |
| 5,340,436 | A | 8/1994 | Beckett | |
| 5,350,904 | A | 9/1994 | Kemske et al. | |
| 5,354,973 | A | 10/1994 | Beckett | |
| 5,410,135 | A | 4/1995 | Pollart | |
| 5,415,340 | A | 5/1995 | Calvert et al. | |
| 5,424,517 | A | 6/1995 | Habeger | |
| 5,519,195 | A | 5/1996 | Keefer | |
| 5,565,228 | A | 10/1996 | Gics | |
| 5,585,027 | A | 12/1996 | Young | |
| 5,628,921 | A | 5/1997 | Beckett | |
| 5,672,407 | A | 9/1997 | Beckett | |
| 5,685,453 | A * | 11/1997 | Goins | B29C 51/00 220/671 |
| 5,698,127 | A | 12/1997 | Lai et al. | |
| 5,705,213 | A | 1/1998 | Guillin | |
| 5,759,422 | A | 6/1998 | Schmelzer | |
| 5,800,724 | A | 9/1998 | Habeger | |
| 5,931,333 | A | 8/1999 | Woodnorth et al. | |
| 6,114,679 | A | 9/2000 | Lai | |
| 6,149,053 | A * | 11/2000 | Chatterton et al. | 229/407 |
| 6,150,646 | A | 11/2000 | Lai | |
| 6,150,647 | A | 11/2000 | Anderson et al. | |
| 6,199,715 | B1 | 3/2001 | Hayes et al. | |
| 6,204,492 | B1 | 3/2001 | Zeng | |
| 6,251,451 | B1 | 6/2001 | Zeng | |
| D458,538 | S * | 6/2002 | Hayes | D9/434 |
| 6,414,290 | B1 | 7/2002 | Cole | |
| 6,415,944 | B1 | 7/2002 | Toussant | |
| 6,433,322 | B2 | 8/2002 | Zeng | |
| 6,455,827 | B2 | 9/2002 | Zeng | |
| 6,463,844 | B1 | 10/2002 | Wang et al. | |
| 6,501,059 | B1 | 12/2002 | Mast | |
| 6,513,675 | B1 * | 2/2003 | Brown et al. | 220/608 |
| 6,552,315 | B2 | 4/2003 | Zeng | |
| 6,608,292 | B1 | 8/2003 | Barnes | |
| 6,639,199 | B1 | 10/2003 | Ross, Jr. | |
| 6,651,874 | B1 | 11/2003 | Pedersen | |
| 6,677,563 | B2 | 1/2004 | Lai | |
| 6,717,121 | B2 | 4/2004 | Zeng | |
| 6,765,182 | B2 | 7/2004 | Cole | |
| 6,919,547 | B2 | 7/2005 | Tsontzidis | |
| 6,988,654 | B2 | 1/2006 | Wnek | |
| 7,019,271 | B2 | 3/2006 | Wnek et al. | |
| 7,205,517 | B2 | 4/2007 | Hoh | |
| 7,228,986 | B2 * | 6/2007 | Hayes | B65D 1/44 220/675 |
| 7,323,669 | B2 | 1/2008 | Robison et al. | |
| 7,351,942 | B2 | 4/2008 | Wnek et al. | |
| 7,365,292 | B2 | 4/2008 | Cole et al. | |
| 7,476,830 | B2 | 1/2009 | Middleton et al. | |
| 7,541,562 | B2 | 6/2009 | Cole et al. | |
| 8,104,635 | B2 * | 1/2012 | Hayes et al. | 220/675 |
| 8,680,448 | B2 | 3/2014 | Wnek et al. | |
| 8,803,050 | B2 | 8/2014 | Lafferty et al. | |
| 2001/0000732 | A1 | 5/2001 | Hopkins, Sr. | |
| 2001/0021405 | A1 | 9/2001 | Zeng | |
| 2003/0085224 | A1 | 5/2003 | Tsontzidis et al. | |
| 2004/0011860 | A1 | 1/2004 | Lebras | |
| 2004/0262322 | A1 | 12/2004 | Middleton et al. | |
| 2005/0082305 | A1 | 4/2005 | Dais et al. | |
| 2005/0205565 | A1 | 9/2005 | Cole | |
| 2006/0011620 | A1 | 1/2006 | Tsontzidis | |
| 2006/0113300 | A1 | 6/2006 | Wnek | |
| 2006/0226208 | A1 * | 10/2006 | Focke et al. | 229/146 |
| 2006/0255042 | A1 * | 11/2006 | Hamano | B65D 1/34 220/314 |
| 2007/0029316 | A1 | 2/2007 | Fernandez | |
| 2007/0221666 | A1 | 9/2007 | Keefe et al. | |
| 2007/0228052 | A1 * | 10/2007 | Hayes | B65D 1/34 220/608 |
| 2008/0000896 | A1 | 1/2008 | Wnek et al. | |
| 2008/0081095 | A1 | 4/2008 | Cole et al. | |
| 2008/0121550 | A1 | 5/2008 | Anderson et al. | |
| 2008/0164178 | A1 | 7/2008 | Wnek et al. | |
| 2008/0305339 | A1 * | 12/2008 | Kotaki | B29C 45/0046 428/409 |
| 2009/0206074 | A1 | 8/2009 | Schneider et al. | |
| 2009/0206075 | A1 | 8/2009 | Lafferty | |
| 2010/0258471 | A1 * | 10/2010 | Enriquez et al. | 206/557 |
| 2010/0278990 | A1 | 11/2010 | Wnek et al. | |
| 2010/0297310 | A1 | 11/2010 | Garbe et al. | |
| 2012/0318810 | A1 | 12/2012 | Hodge et al. | |
| 2014/0263364 | A1 | 9/2014 | Netzer et al. | |

FOREIGN PATENT DOCUMENTS

| | | | | |
|---|---|---|---|---|
| DE | 79 03 283 | | 5/1979 | |
| EP | 0 007 522 | | 2/1980 | |
| EP | 0 246 041 | | 11/1987 | |
| EP | 0 382 399 | | 8/1990 | |
| FR | 2738001 | B1 * | 9/1997 | B65D 1/165 |
| FR | CA 2294630 | A1 * | 10/1999 | B65D 5/20 |
| FR | 2777541 | B1 * | 7/2000 | B65D 5/20 |
| GB | 955883 | | 4/1964 | |
| GB | 2 407 153 | | 4/2005 | |
| JP | 62-293020 | | 12/1987 | |
| JP | 7-33228 | | 6/1995 | |
| JP | 10-278974 | A | 10/1998 | |
| JP | 2003-95332 | | 4/2003 | |
| JP | 2003-137363 | A | 5/2003 | |
| JP | 2003-165582 | | 6/2003 | |
| JP | 2007-312819 | | 12/2007 | |

(56) References Cited

FOREIGN PATENT DOCUMENTS

| | | | |
|---|---|---|---|
| KR | 10-0436263 | | 6/2004 |
| KR | 20-0357454 | Y1 | 7/2004 |
| KR | 10-0813904 | | 3/2008 |
| KR | 20-2013-0004074 | U | 7/2013 |
| WO | WO 93/23971 | | 11/1993 |
| WO | WO 95/24110 | | 9/1995 |
| WO | WO 96/22228 | | 7/1996 |
| WO | WO 03/041451 | | 5/2003 |
| WO | WO 2004/020310 | | 3/2004 |
| WO | WO 2005/085091 | | 9/2005 |
| WO | WO 2007/133767 | | 11/2007 |
| WO | WO 2008/144343 | | 11/2008 |
| WO | WO 2009/105397 | | 8/2009 |
| WO | WO 2009/105398 | | 8/2009 |
| WO | WO 2010/127214 | | 11/2010 |

* cited by examiner

CONSTRUCT WITH STIFFENING FEATURES

CROSS REFERENCE TO RELATED APPLICATIONS

This application claims the benefit of U.S. Provisional Patent Application No. 61/963,866, filed Dec. 16, 2013.

INCORPORATION BY REFERENCE

The disclosure of U.S. Provisional Patent Application No. 61/963,866, which was filed on Dec. 16, 2013, is hereby incorporated by reference for all purposes as if presented herein in its entirety.

BACKGROUND OF THE DISCLOSURE

The present disclosure generally relates to cartons, trays, and/or other constructs for holding food products and/or other types of articles. More specifically, the present disclosure relates to materials and constructs that may include stiffening features.

SUMMARY OF THE DISCLOSURE

In general, one aspect of the disclosure is generally directed to a construct for supporting at least one article. The construct can comprise at least a panel and a plurality of stiffening features. The plurality of stiffening features can comprise a pattern of bosses formed in the panel. The pattern of bosses can be configured for at least partially reducing buckling of the panel.

In another aspect, the disclosure is generally directed to a method of forming a construct.

The method can comprise obtaining a web of material comprising at least a panel and forming a plurality of stiffening features in the panel. The forming the plurality of stiffening features can comprise forming a pattern of bosses in the panel for at least partially reducing buckling of the panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The package of the present disclosure can be useful in containing one or more products (e.g., a food product) or other articles such as any suitable type of product that can be stored, transported, cooled, frozen, heated, and/or cooked (e.g., in a microwave oven). Some suitable products could comprise a frozen, refrigerated, or other pizza, sandwich, vegetables, popcorn, cuts of meat, or any other suitable food product or other article. Further, the package of the present disclosure can be used for heating, cooking, browning, crisping, etc. the food product by use of a heating or cooking device such as a microwave oven. It is understood that food products other than the food products listed herein may be contained in the package. Further, products contained in this package may be generally rectangular, triangular, round, square, irregular, or any other shape. In this specification, the terms "inner," "interior," "outer," "exterior," "lower," "bottom," "upper," and "top" indicate orientations determined in relation to fully erected and upright packages.

Figure 1:
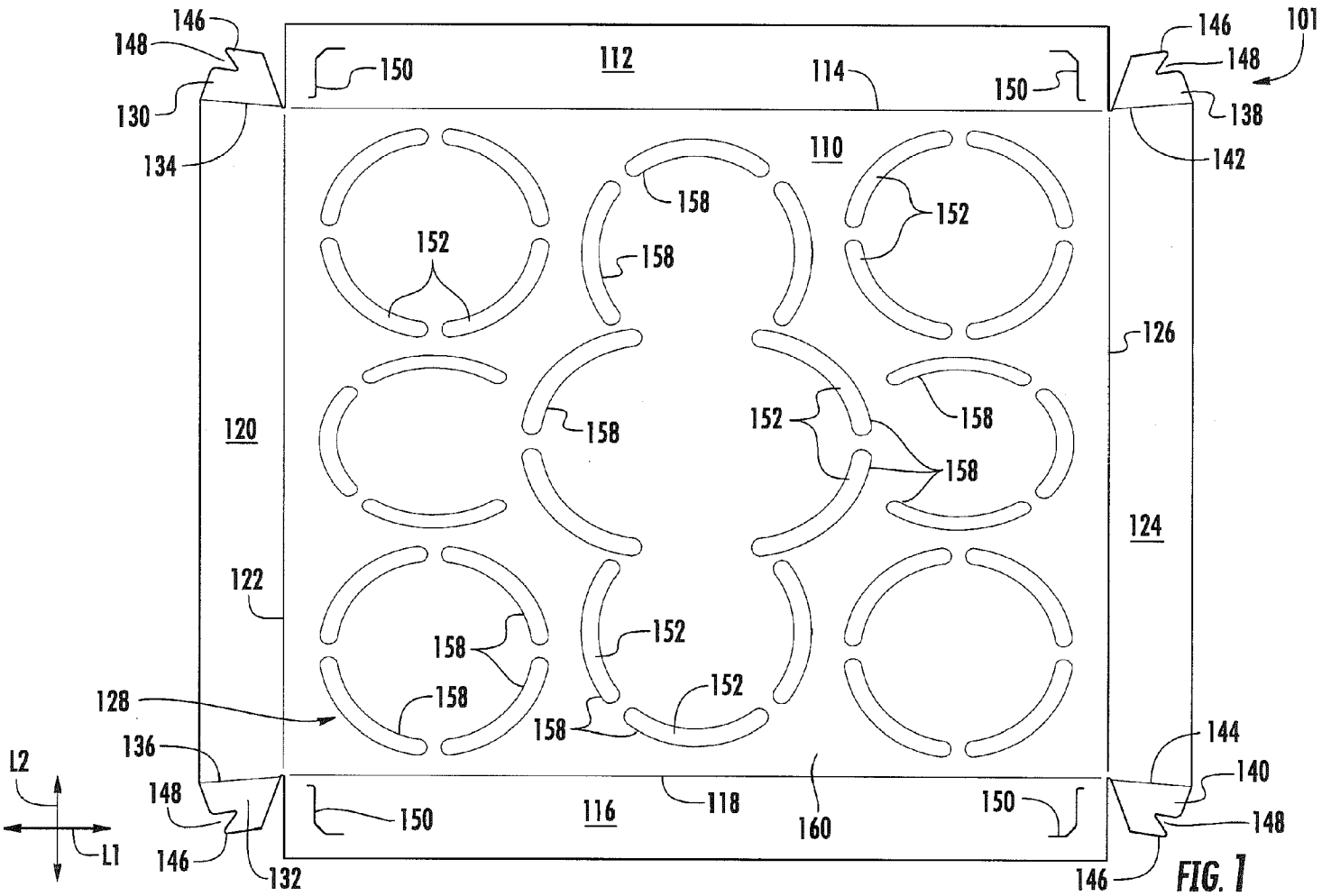
FIG. 1 is a plan view of a blank used to form an exemplary tray according to a first embodiment of the present disclosure.
Figure 2:
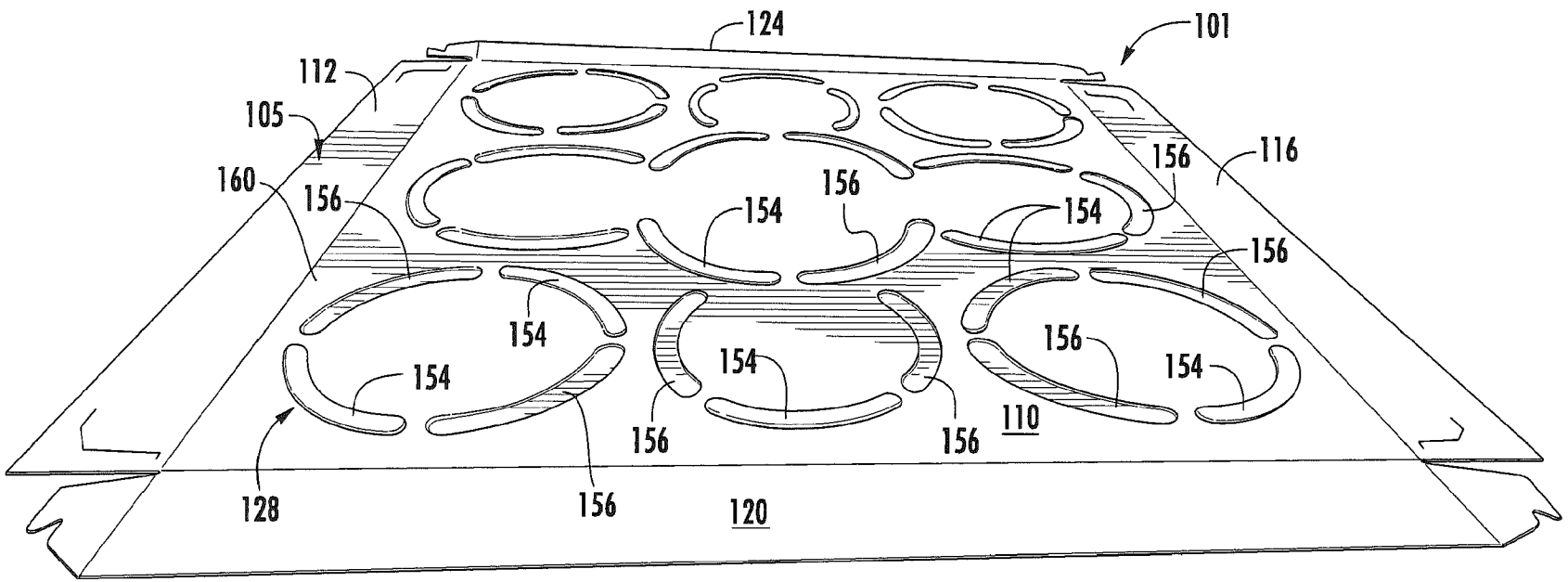
FIGS. 2 and 3 are perspective views of the blank of FIG. 1.
Figure 3:
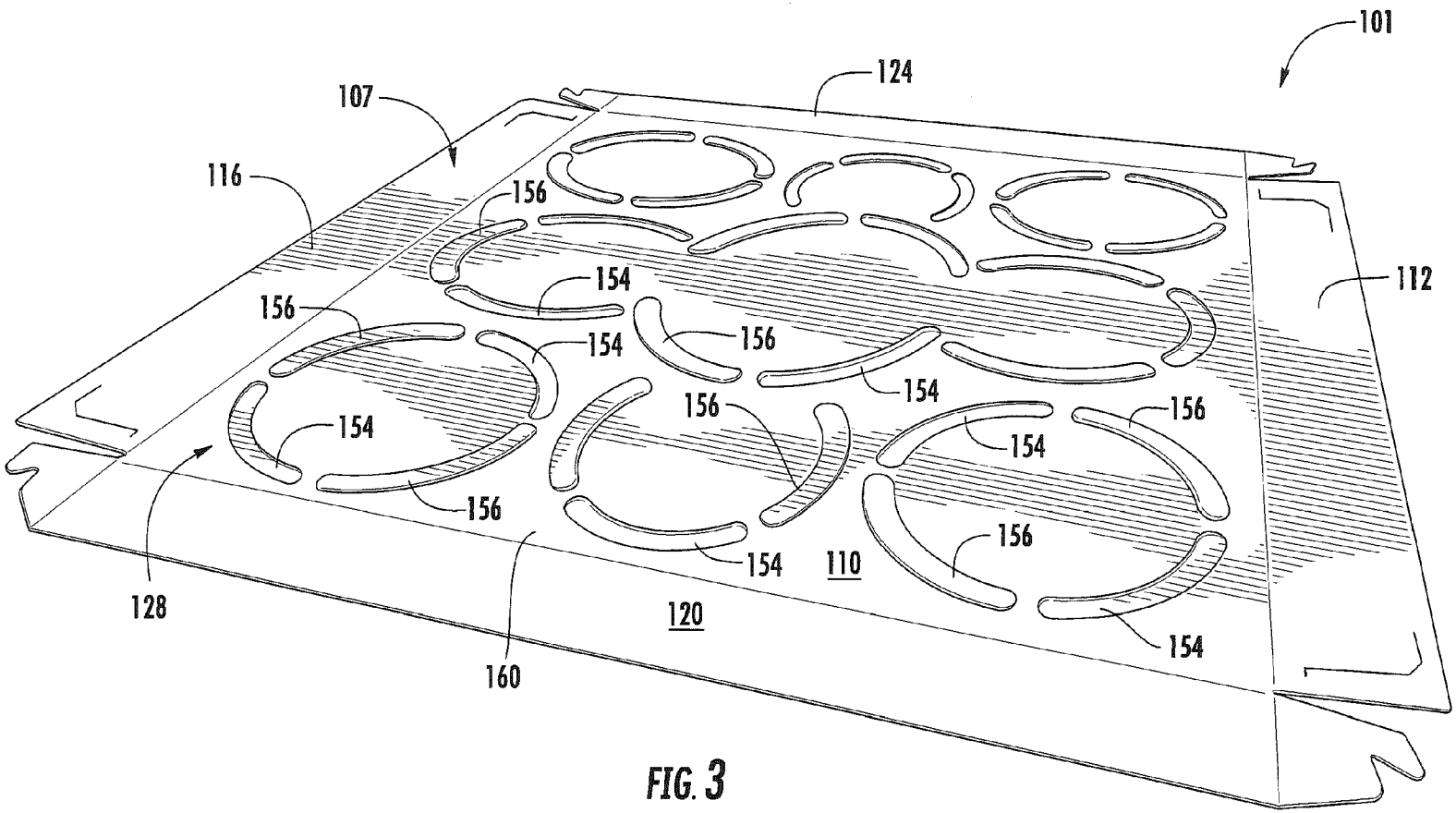

FIG. 1 is a plan view of a blank, generally indicated at 101, used to form a package or tray (broadly "construct") 103 (FIGS. 4-6) of an exemplary embodiment of the disclosure. In one embodiment, the blank 101 can have an interior surface 105 (FIG. 2) and an exterior surface 107 (FIG. 3). The tray 103 is used to hold and/or support a food product (not shown), such as a French bread pizza, sandwich, turnover, burrito, meats, or any other food product, during cooking, refrigerating, freezing, etc. of the food product. In one embodiment, at least a portion of the tray 103 may have an element (not shown) for use in cooking, heating, browning, and/or shielding (e.g., a microwave energy interactive element, such as, but not limited to, a susceptor) mounted thereto. Alternatively, a microwave energy interactive element can be omitted from the tray 103. In an alternative embodiment, the tray 103 can hold and/or support a non-food item or article.

The blank 101 has a longitudinal axis L1 and a lateral axis L2. The blank 101 includes a central panel 110 foldably connected to a first side panel 112 at a first longitudinal fold line 114. A second side panel 116 is foldably connected to the central panel 110 along a second longitudinal fold line 118. A first end panel 120 is foldably connected to the central panel 110 along a first lateral fold line 122 at one longitudinal end of the central panel 110, and a second end panel 124 is foldably connected to the central panel 110 along a second lateral fold line 126 at another longitudinal end of the central panel 110. As shown in FIG. 1, the central panel 110 can include a plurality stiffening features 128. Alternatively, the stiffening features 128 can be omitted or otherwise configured, arranged, or positioned without departing from the scope of the disclosure.

In the illustrated embodiment, the blank 101 includes end flaps 130, 132 foldably connected to the first end panel 120 along respective fold lines 134, 136 at respective ends of the first end panel 120. End flaps 138, 140 are respectively foldably connected to the second end panel 124 along the respective fold lines 142, 144 at respective ends of the second end panel 124. Each of the end flaps 130, 138, 132, 140 includes a locking feature, such as a projection 146 and a recess 148 for engaging a respective slit 150 in a respective side panel 112, 116. The end flaps could be otherwise shaped, arranged, positioned, and/or configured without departing from the disclosure. For example, the locking features could be omitted from the end flaps 130, 132, 138, 140, and/or the end flaps 130, 138, 132, 140 could be glued to the respective side panels 112, 116. In an alternative embodiment, the end flaps 130, 138, 132, 140 could be foldably connected to the respective side panels 112, 116, and the slits 150 could be disposed in the end panels 120, 124. Alternatively, the end flaps 130, 132, 138, 140 could be omitted from the blank 101 without departing from the disclosure.

As shown in FIG. 1, the plurality of stiffening features 128 can include one or more patterns of bosses 152 formed in the central panel 110. Only a representative few of the bosses 152 are identified by their reference numbers in FIG. 1. In the illustrated embodiment, the bosses 152 can include emboss features 154 and deboss features 156 (FIGS. 2 and 3). For example, the emboss features 154 can comprise depressions or grooves in the interior surface 105 and raised portions in the exterior surface 107 of the blank 101, and the deboss features 156 can comprise raised portions in the interior surface 105 and depressions or grooves in the exterior surface 107. As shown in FIGS. 1-3, each of the bosses 152 is at least partially defined by an edge 158, which can be a transition between the bossed areas and the neutral area 160 of the central panel 110. For example, the neutral area 160 can be a generally planar portion of the central panel 110, and the bosses 152 can extend from the plane of the neutral area 160 at the edges 158. In one embodiment, the edges 158 can be generally perpendicular to the plane of the central panel 110. Alternatively, the edges 158 could be sloped or curved transitions. In one embodiment, one or more edges 158 could be a transition between an emboss feature 154 and a deboss feature 156. As shown in FIGS. 1-3, the bosses 152 are curved segments in circular (and/or other elliptical shapes), semicircular, or horseshoe-shaped (e.g., semielliptical) arrangements within the overall pattern of the plurality of stiffening features 128. The arrangements, patterns, and/or shapes of the bosses 152 are shown by way of example, and other arrangements, patterns, and/or shapes could be used. For example, in an alternative embodiment, the curved segments could be longer, shorter, enclosed shapes (e.g., circles, ovals, hourglasses, etc.), or any other suitable configuration.

As shown in FIGS. 2 and 3, the emboss features 154 and the deboss features 156 can alternate in the pattern of bosses 152 in the central panel 110. In alternative embodiments, the emboss features 154 and/or deboss features 156 could be otherwise configured. For example, the emboss features and/or deboss features could be grouped together, interspersed, or otherwise arranged. In another example, the bosses 152 could be all emboss features 154 or all deboss features 156. One or more of the bosses 152, emboss features 154, and/or deboss features 156 could be omitted or could be otherwise shaped, arranged, positioned, and/or configured without departing from the disclosure.

In one embodiment, the blank 101 can be formed from a web of material. For example, areas of the material can be deformed upwardly with respect to the neutral area 160 to form the emboss features 154, and areas of the material can be deformed downwardly with respect to the neutral area 160 to form the deboss features 156. Any of the fold lines 114, 118, 122, 126, 134, 136, 142, 144, the cut lines 150, and/or the edges of the blank 101 could be formed before or after the bosses 152 in the web of material. The blank 101, including the bosses 152, could be otherwise formed without departing from the disclosure. Additionally, in alternative embodiments, the blank 101 could be otherwise shaped, arranged, and/or configured.

Figure 4:
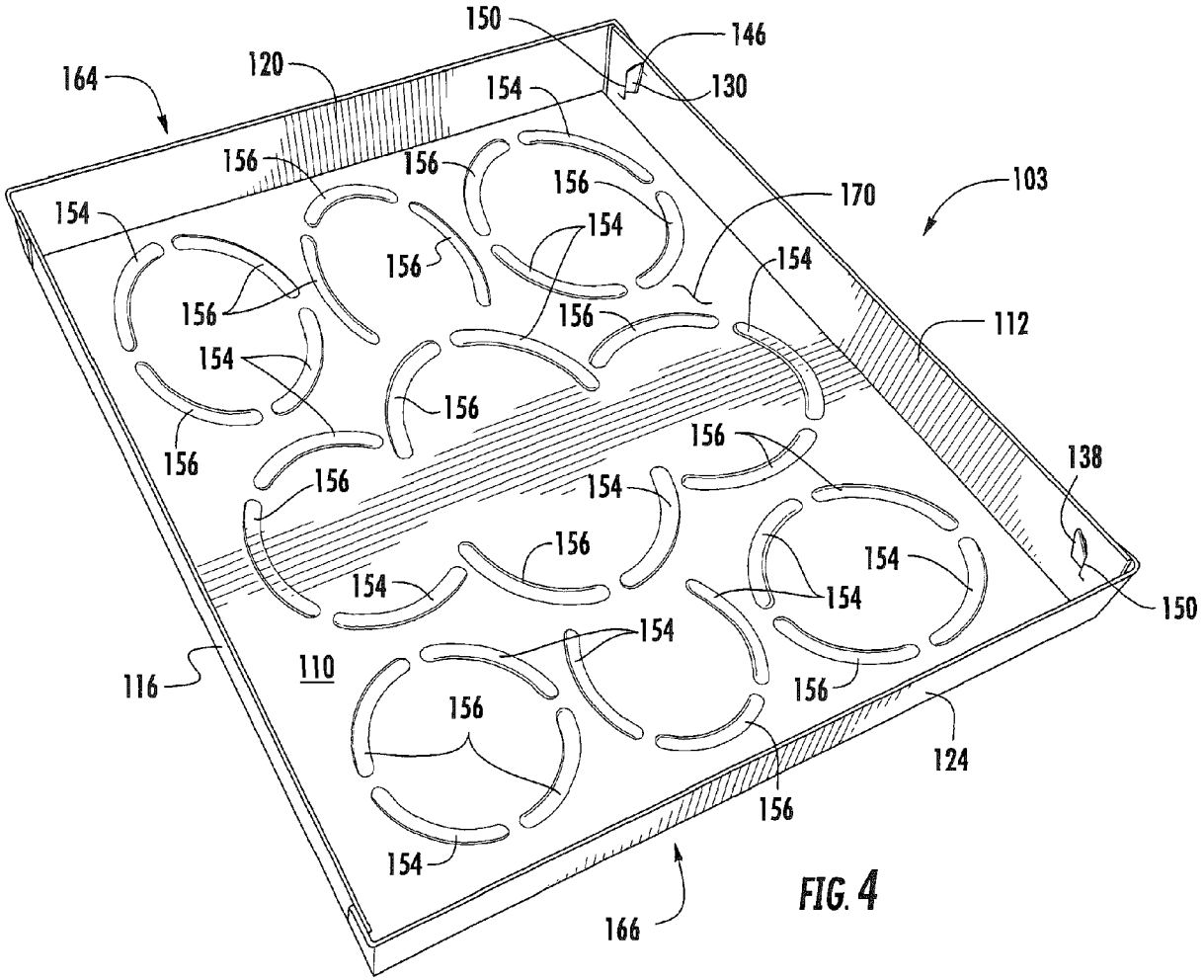
FIGS. 4-6 are perspective views of the erected tray according to the first embodiment of the present disclosure.
Figure 5:
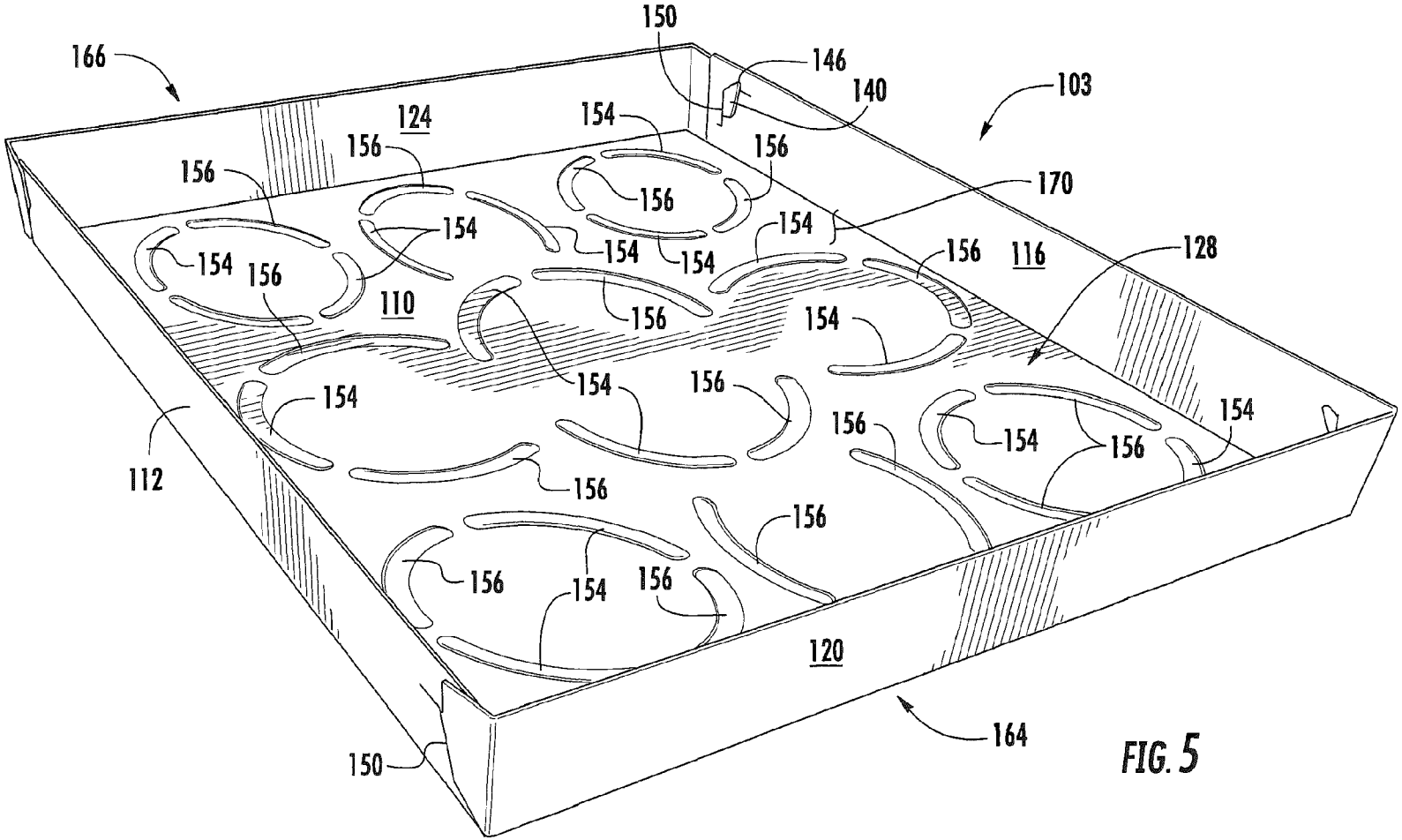
Figure 6:
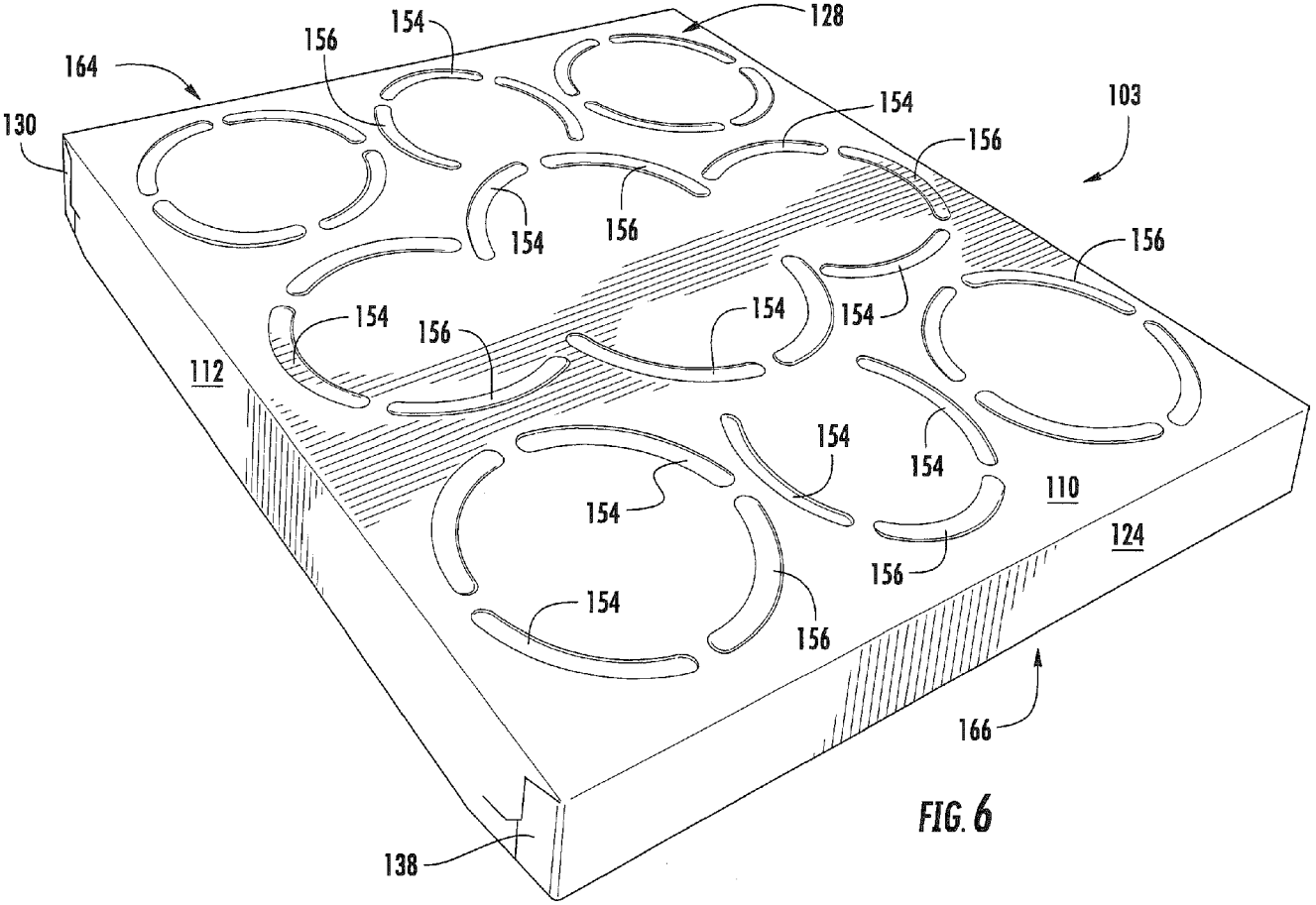

As shown in FIGS. 4-6 and described in the following in accordance with one acceptable example, the tray 103 is formed from the blank 101 by first upwardly folding the side panels 112, 116 along the respective longitudinal fold lines 114, 118 and folding the end panels 120, 124 along the respective lateral fold lines 122, 126. Each of the end flaps 130, 138 can be folded along the respective lateral fold lines 134, 142 into face-to-face contact with the exterior surface of the first side panel 112 and inserted into the respective slits 150 so that the projections 146 and recesses 148 engage the respective slits 150. Additionally, each of the end flaps 132, 140 can be folded along the respective lateral fold lines 136, 144 into face-to-face contact with the exterior surface of the second side panel 116 and inserted into the respective slits 150 so that the projections 146 and recesses 148 engage the respective slits 150. Accordingly, the first end panel 120 and the end flaps 130, 132 form a first closed end 164 of the tray 103. Similarly, the second end panel 124 and the end flaps 138, 140 form a second closed end 166 of the tray 103. Alternatively, the end flaps 130, 138, 132, 140 can be folded into face-to-face contact with the interior surfaces of the respective side panels 112, 116. As shown in FIGS. 4 and 5, the central panel 110, the side panels 112, 110, and the closed ends 164, 166 form the interior 170 of the tray 103. Alternative assembling, loading, and closing steps may be used without departing from the scope of the disclosure. For example, the end flaps 130, 138, 132, 140 can be glued into face-to-face contact with the respective side panels 112, 116 in addition, or alternatively, to interlocking the end flaps to the side panels via the projections 146 and the slits 150.

In the illustrated embodiment, the stiffening features 128 can help prevent buckling, bending, and/or other failure of the central panel 110. For example, the bosses 152 can be arranged so that little or none of the edges 158 are aligned with the grain of the blank 101 (in one embodiment, the grain is parallel to the longitudinal direction L1). For example, each of the edges 158 can have a length (e.g., extending around the perimeter of the respective boss 152), and the edge 158 can be nonparallel with the grain of the blank 101 along at least a majority of the length of the edge 158. In another embodiment, the edge 158 is nonparallel with the grain along at least a portion of the length of the edge 158. If the central panel 110 starts to buckle or fold, a fold or crease can start to propagate across the central panel. For example, in one embodiment, a central panel with the stiffening features omitted could form a fold (e.g., buckle) at one corner, and the fold could propagate to extend to the opposing corner, which could cause the tray to collapse. However, for the central panel 110, a fold or crease can intersect with a boss 152 and be redirected along the edge 158 of the boss. The fold can propagate along at least a portion of the edge 158, and the fold can stop or continue to another boss 152, which can further redirect the fold. Accordingly, the bosses 152 can disrupt a fold or crease in the central panel 110 and can help prevent a fold or crease from extending across the central panel 110 to help prevent failure of the tray 103. In one embodiment, the stiffening features 128 can result in a ten percent increase in strength of the central panel 110. For example, a central panel with the stiffening features and comprising an 18 point paperboard might replace a panel without the stiffening features and comprising 20 point paperboard.

In the illustrated embodiment, the plurality of stiffening 128 features is formed in the central panel 110 of the tray 103. In alternative embodiments, however, the stiffening features can be formed in one or more panels of any suitable construct (e.g., fully enclosed carton, wrap, basket carrier, divider panel, etc.). The blank 101 and tray 103 are included by way of example only. Additionally, as shown in FIG. 1, the bosses 152 comprise a certain percentage of the blank 101 (e.g., the total embossed and/or debossed area of the central panel 110 could be approximately 14% of the central panel). However, more or less of the blank could comprise embossed and/or debossed features (e.g., any suitable area of the central panel 110 could be embossed and/or debossed), and/or the bosses 152 could be longer, wider, shorter, narrower, or any suitable size without departing from the disclosure.

Figure 7:
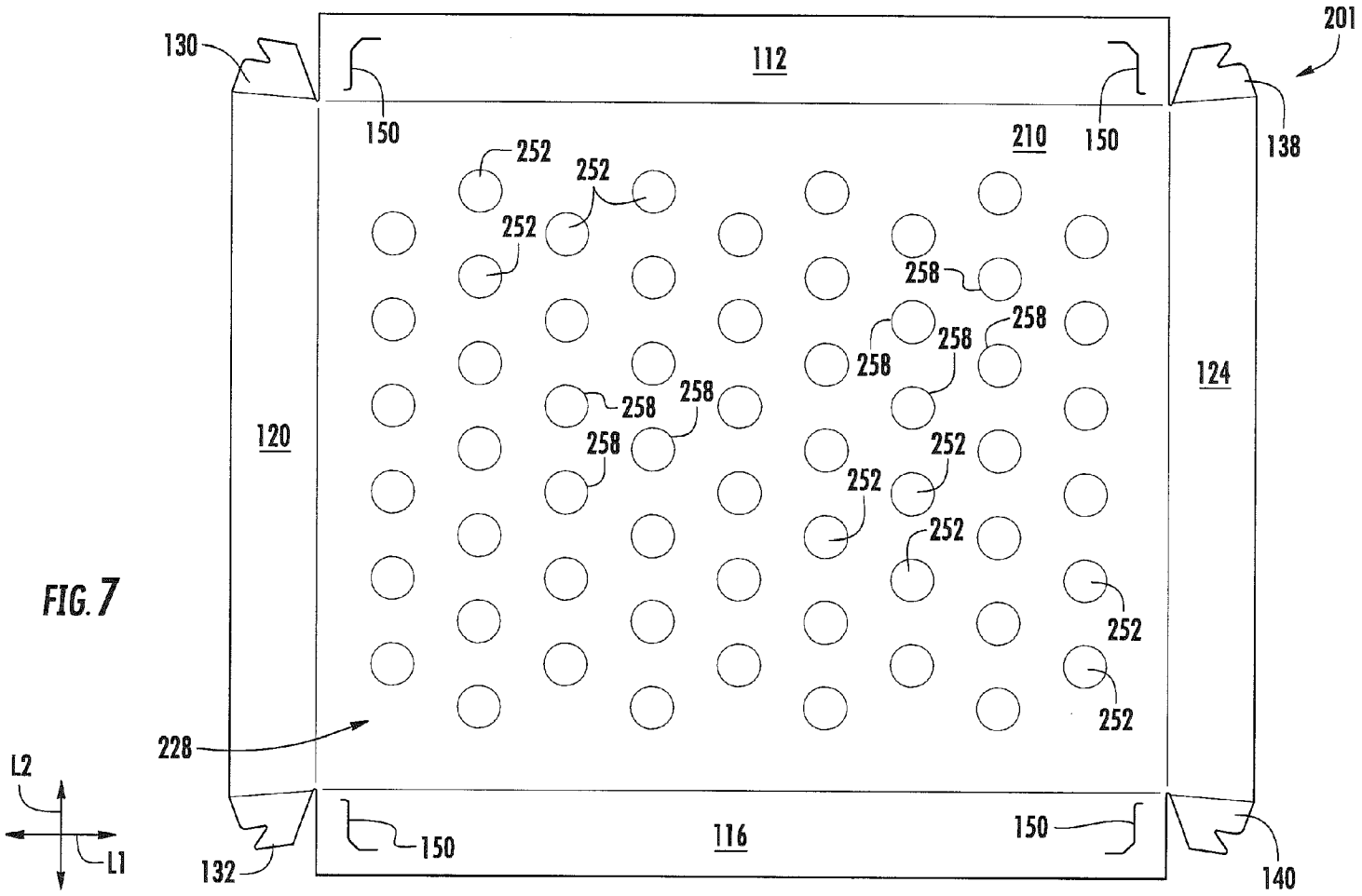
FIG. 7 is a plan view of a blank used to form an exemplary tray according to a second embodiment of the disclosure.

FIG. 7 illustrates a blank 201 for forming a tray (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 7, the blank 201 includes a central panel 210 with a plurality of alternative stiffening features 228. In the second embodiment, the stiffening features 228 can include an array of bosses 252 in the form of circles (and/or other ellipses) or dots. As shown in FIG. 7, the bosses 252 can be defined by circular edges 258. The bosses 252 can be embossed and/or debossed (e.g., embossed features interspersed with deboss features, or any other suitable configuration). As shown in FIG. 7, the bosses 252 are aligned in a number of rows, each row being offset from the adjacent row(s). In alternative embodiments, the bosses 252 could be arranged in an array with aligned columns and rows, could be offset in any or all directions, could be randomly disposed, or could be arranged in any suitable configuration. The bosses 252 could be omitted or could be otherwise shaped, arranged, positioned, and/or configured without departing from the disclosure.

Figure 8:
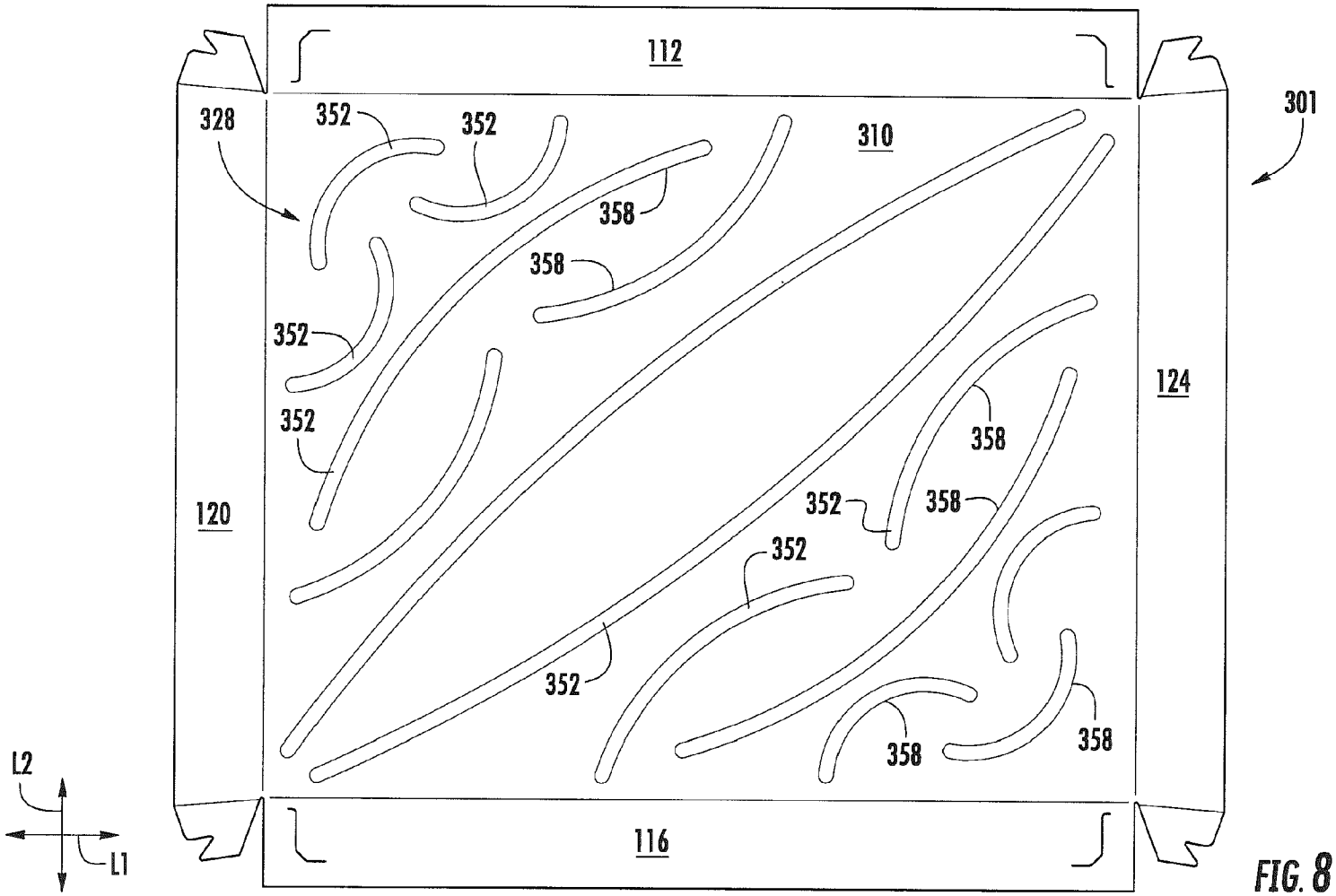
FIG. 8 is a plan view of a blank used to form an exemplary tray according to a second embodiment of the disclosure.

FIG. 8 illustrates a blank 301 for forming a tray (not shown) according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 8, the blank 301 includes a central panel 310 with a plurality of alternative stiffening features 328. In the third embodiment, the stiffening features 328 can include an arrangement of bosses 352 in the form of curves (e.g., elongate curves). As shown in FIG. 8, the bosses 352 can be defined by arcuate edges 358. The bosses 352 can be embossed and/or debossed (e.g., embossed features interspersed with deboss features, or any other suitable configuration). As shown in FIG. 8, the bosses 352 can be arranged with alternating radii of curvature. For example, the upper left boss is curved toward the upper left, then two bosses curved toward the lower right are disposed adjacent the upper left boss. A longer boss curved toward the upper left is next, followed by two bosses curved towards the lower left, and then a boss extending from the lower left corner to the upper right corner and curved toward the upper left corner. The remaining bosses generally can be a mirror image of the upper left bosses. In alternative embodiments, the bosses 352 could be arranged in any suitable configuration. The bosses 352 could be omitted or could be otherwise shaped, arranged, positioned, and/or configured without departing from the disclosure.

Figure 9:
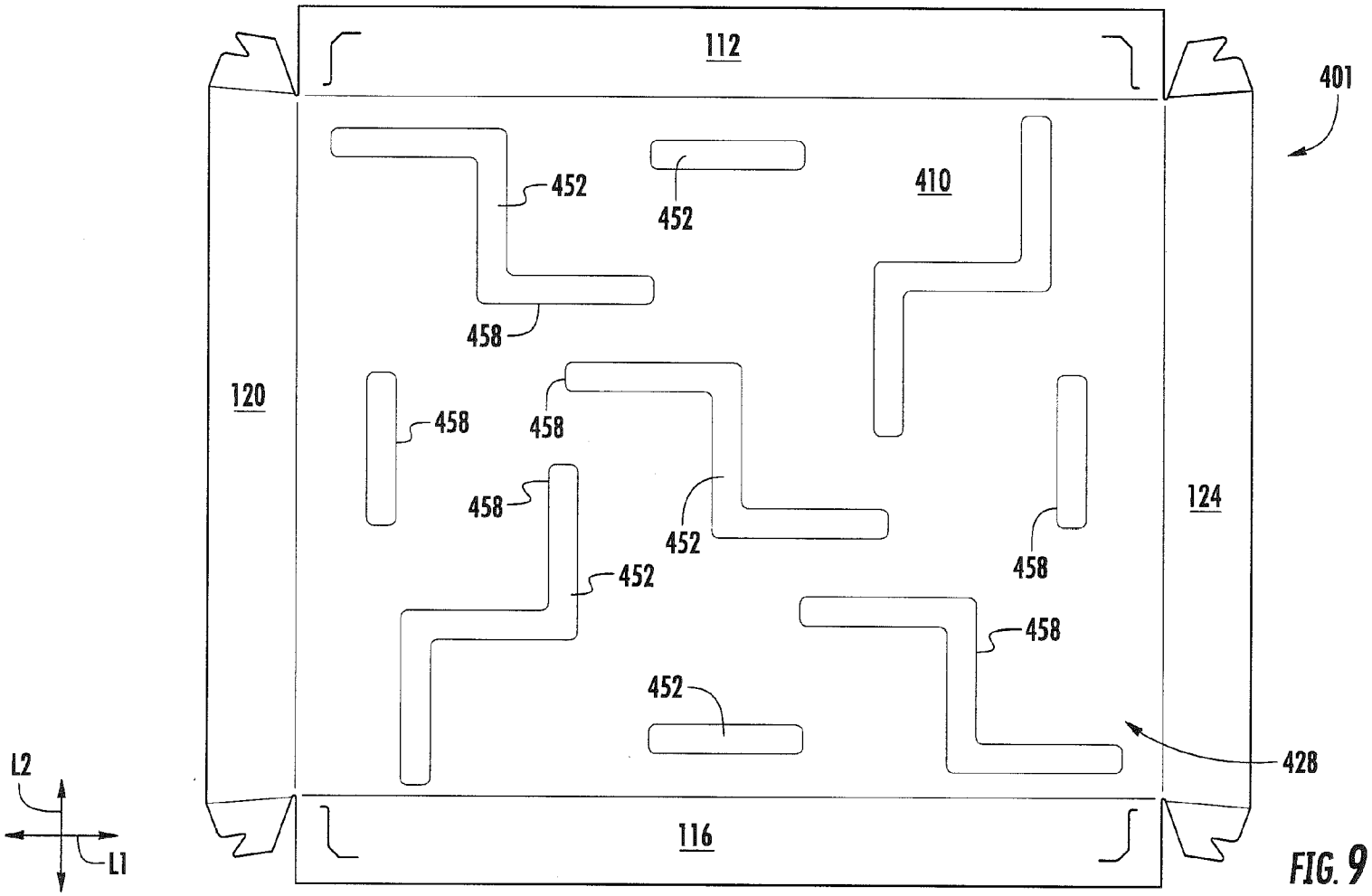
FIG. 9 is a plan view of a blank used to form an exemplary tray according to a second embodiment of the disclosure.

FIG. 9 illustrates a blank 401 for forming a tray (not shown) according to a fourth embodiment of the disclosure. The fourth embodiment is generally similar to the first embodiment, except for variations noted and variations that will be apparent to one of ordinary skill in the art. Accordingly, similar or identical features of the embodiments have been given like or similar reference numbers. As shown in FIG. 9, the blank 401 includes a central panel 410 with a plurality of alternative stiffening features 428. In the fourth embodiment, the stiffening features 428 can include an arrangement of bosses 452 in the form of generally straight lines (e.g., generally straight segments) and lines with angles so that the boss has two generally longitudinal segments connected by a generally lateral segment or two generally lateral segments connected by a generally longitudinal segment. As shown in FIG. 9, the bosses 452 can be defined by edges 458. In alternative embodiments, the bosses 452 could be arranged in any suitable configuration. The bosses 452 can be embossed and/or debossed (e.g., embossed features interspersed with deboss features, or any other suitable configuration). The bosses 452 could be omitted or could be otherwise shaped, arranged, positioned, and/or configured without departing from the disclosure.

Figure 10:
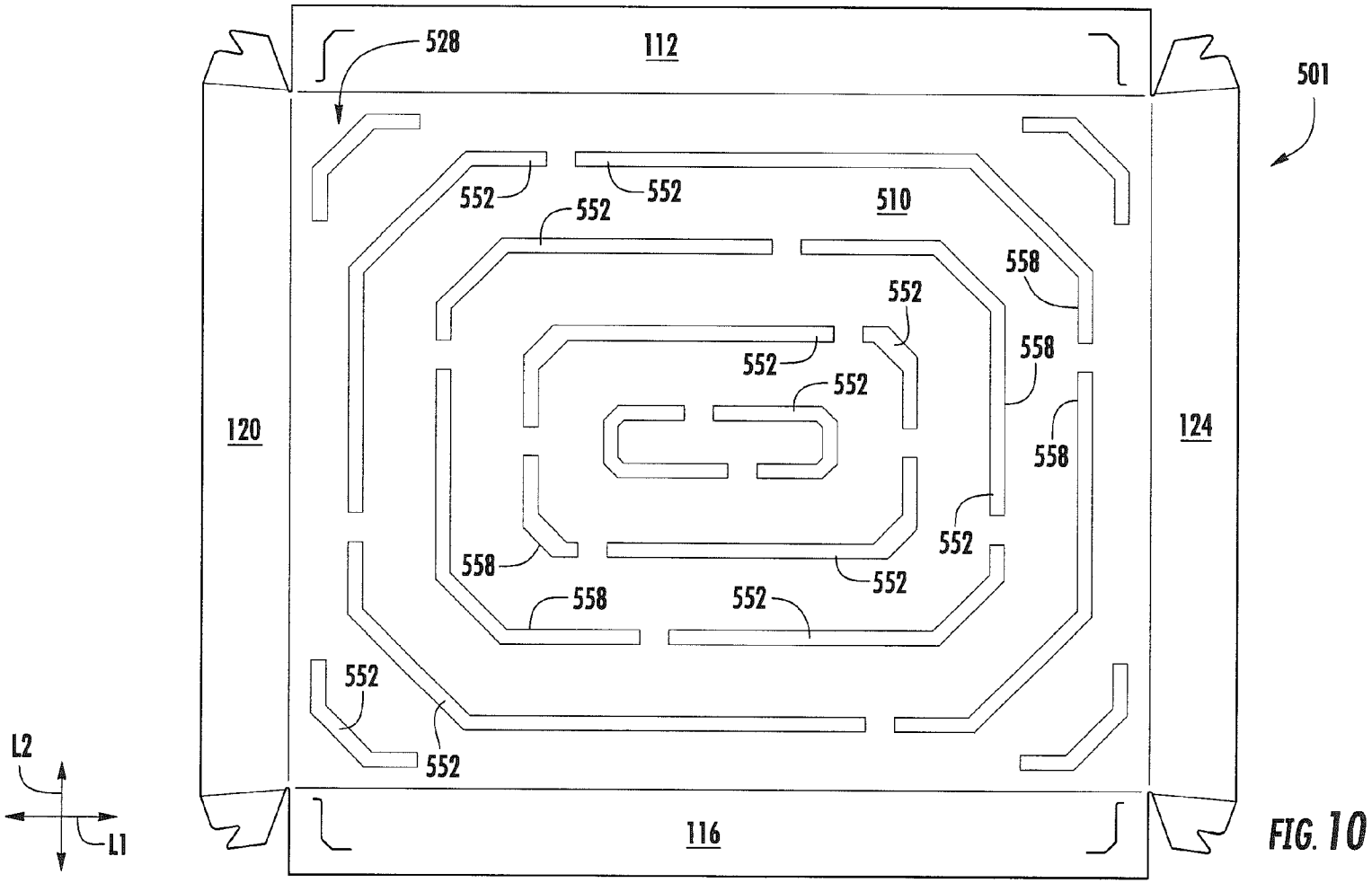
FIG. 10 is a plan view of a blank used to form an exemplary tray according to a second embodiment of the disclosure.

FIG. 10 illustrates a blank 501 for forming a tray (not shown) according to a fifth embodiment of the disclosure. The fifth embodiment is generally similar to the first embodiment, except for variations noted and variations that will be apparent to one of ordinary skill in the art. Accordingly, similar or identical features of the embodiments have been given like or similar reference numbers. As shown in FIG. 10, the blank 501 includes a central panel 510 with a plurality of alternative stiffening features 528. In the fifth embodiment, the stiffening features 528 can include an arrangement of bosses 552 in the form of angled lines (e.g., an oblique segment connecting an end of a longitudinal segment to an end of a lateral segment). As shown in FIG. 10, the bosses 552 can be defined by edges 558. The bosses 552 can be embossed and/or debossed (e.g., embossed features interspersed with deboss features, or any other suitable configuration). As shown in FIG. 10, the bosses 552 can be arranged in concentric polygons, for example. In alternative embodiments, the bosses 552 could be arranged in any suitable configuration. The bosses 552 could be omitted or could be otherwise shaped, arranged, positioned, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the stiffening features of the various embodiments can be incorporated into a tray, carrier, carton, or any other suitable construct having any suitable style or panel configuration. The trays described above are included by way of example. For example, the stiffening features could be included in one or more panels and/or flaps of a fully enclosed carton, a basket-style carrier, a wrap-around carrier, a divider, etc. Additionally, the shapes of the stiffening features (i.e., the shapes of the edges defining the various bosses described above) can be substantially any shape. The shapes described above and included in the figures are included by way of example.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A construct for supporting at least one article, the construct comprising:

at least a panel; and a plurality of stiffening features comprising a pattern of bosses formed in the panel, the pattern of bosses being configured for at least partially reducing buckling of the panel, the pattern of bosses comprising:

at least one emboss and at least one deboss, wherein the at least one emboss is spaced apart from the at least one deboss by a neutral area of the panel, the neutral area of the panel comprising a first planar surface extending between the at least one emboss and the at least one deboss and extending to an outer edge of the panel, the at least one emboss is at least partially defined by an emboss edge, the at least one deboss is at least partially defined by a deboss edge, an entirety of the emboss edge abutting the neutral area and extending from the first planar surface to a second planar surface in a first direction, the emboss edge comprising an outer peripheral emboss edge portion, an inner peripheral emboss edge portion, a first curved radial emboss edge end, and a second curved radial emboss edge end, the first curved radial emboss edge end and the second curved radial emboss edge end each connecting the outer peripheral emboss edge portion and the inner peripheral emboss edge portion, and an entirety of the deboss edge abutting the neutral area and extending from the first planar surface to a third planar surface in a second direction, the deboss edge comprising an outer peripheral deboss edge portion, an inner peripheral deboss edge portion, a first curved radial deboss edge end, and a second curved radial deboss edge end, the first curved radial deboss edge end and the second curved radial deboss edge end each connecting the outer peripheral deboss edge portion and the inner peripheral deboss edge portion, the second direction being opposite the first direction, and the first planar surface extending between the first curved radial emboss edge and the first curved radial deboss edge.

2. The construct of claim 1, wherein at least one of the emboss edge and the deboss edge extends perpendicular to the neutral area of the panel.

3. The construct of claim 1, wherein the emboss edge extends around a perimeter of the at least one emboss and the deboss edge extends around a perimeter of the at least one deboss.

4. The construct of claim 1, wherein each of the edges is curved.

5. The construct of claim 1, wherein the panel comprises a grain direction, and at least a majority of each of the edges is nonparallel with the grain direction.

6. The construct of claim 1, wherein the pattern of bosses comprises a plurality of emboss features and a plurality of deboss features.

7. The construct of claim 6, wherein the deboss features of the plurality of deboss features are interspersed with the emboss features of the plurality of emboss features.

8. The construct of claim 1, wherein each of the bosses of the pattern of bosses comprises a curved segment.

9. The construct of claim 8, wherein the curved segments are disposed in at least one elliptical arrangement in the panel.

10. The construct of claim 8, wherein the curved segments are disposed in at least one semielliptical arrangement in the panel.

11. The construct of claim 8, wherein the curved segments are disposed in at least one semielliptical arrangement adjacent and in at least one elliptical arrangement in the panel.

12. The construct of claim 1, wherein each of the bosses of the pattern of bosses comprises a circle.

13. The construct of claim 12, wherein the circles are arranged in at least a first row and a second row, the first row being generally offset from the second row.

14. The construct of claim 1, wherein each of the bosses of the pattern of bosses comprises an elongate curve.

15. The construct of claim 14, wherein each of the elongate curves comprises a radius of curvature, and the elongate curves are arranged in the blank so that each elongate curve has a generally opposing radius of curvature relative to the radius of curvature of an adjacent one of the elongate curves.

16. The construct of claim 1, wherein each of the bosses of the pattern of bosses comprises a generally longitudinal segment or a generally lateral segment.

17. The construct of claim 16, wherein at least one of the generally longitudinal segments extends between respective ends of two of the generally lateral segments.

18. The construct of claim 1, wherein each of the bosses of the pattern of bosses comprises a generally longitudinal segment, a generally lateral segment, or an oblique segment.

19. The construct of claim 18, wherein each of the oblique segments extends from an end of one of the generally longitudinal segments to an end of one of the generally lateral segments.

20. The construct of claim 18, wherein the generally longitudinal segments, the generally lateral segments, and the oblique segments are arranged in a plurality of generally concentric polygonal shapes.

21. The construct of claim 1, wherein the construct is formed from a blank.

22. The construct of claim 1, wherein the construct is a tray.

23. The construct of claim 1, wherein the construct comprises at least one flap foldably connected to the panel.

24. The construct of claim 1, wherein the construct comprises paperboard.

25. The construct of claim 1, wherein the first planar surface of the panel surrounds the entire perimeter of the at least one emboss and the at least one deboss.

26. The construct of claim 1, wherein the first planar surface abuts the emboss edge around the entire perimeter of the at least one emboss and the first planar surface abuts the deboss edge around the entire perimeter of the at least one deboss.

27. The construct of claim 1, wherein the outer edge is one of a plurality of outer edges of the panel, the first planar surfaced extending to each of the plurality of outer edges of the panel.

28. A method of forming a construct, the method comprising:

obtaining a web of material comprising at least a panel; and forming a plurality of stiffening features in the panel comprising forming a pattern of bosses in the panel for at least partially reducing buckling of the panel, the pattern of bosses comprising:

at least one emboss and at least one deboss, wherein the at least one emboss is spaced apart from the at least one deboss by a neutral area of the panel, the neutral area of the panel comprising a first planar surface extending between the at least one emboss and the at least one deboss and extending to an outer edge of the panel, the at least one emboss is at least partially defined by an emboss edge, the at least one deboss is at least partially defined by a deboss edge, an entirety of the emboss edge abutting the neutral area and extending from the first planar surface to a second planar surface in a first direction, the emboss edge comprising an outer peripheral emboss edge portion, an inner peripheral emboss edge portion, a first curved radial emboss edge end, and a second curved radial emboss edge end, the first curved radial emboss edge end and the second curved radial emboss edge end each connecting the outer peripheral emboss edge portion and the inner peripheral emboss edge portion, and an entirety of the deboss edge abutting the neutral area and extending from the first planar surface to a third planar surface in a second direction, the deboss edge comprising an outer peripheral deboss edge portion, an inner peripheral deboss edge portion, a first curved radial deboss edge end, and a second curved radial deboss edge end, the first curved radial deboss edge end and the second curved radial deboss edge end each connecting the outer peripheral deboss edge portion and the inner peripheral deboss edge portion, the second direction being opposite the first direction, and the first planar surface extending between the first curved radial emboss edge and the first curved radial deboss edge.

29. The method of claim 28, wherein the construct is a blank, and the method further comprises forming the blank into a tray for supporting at least one article.

30. The method of claim 29, wherein the blank comprises at least one flap foldably connected to the panel, and the forming the blank into a tray comprises folding the at least one flap relative to the panel.

31. The method of claim 28, wherein each emboss edge and each deboss extends generally perpendicular to the neutral area of the panel.

32. The method of claim 28, wherein the forming the pattern of bosses comprises forming a plurality of emboss features and a plurality of deboss features so that the deboss features of the plurality of deboss features are interspersed with the emboss features of the plurality of emboss features.

33. The method of claim 28, wherein each of the bosses of the pattern of bosses comprises a curved segment.

34. The method of claim 33, wherein the forming the pattern of bosses comprises disposing the curved segments in at least one of a semielliptical arrangement and an elliptical arrangement in the panel.

35. The method of claim 28, wherein each of the bosses of the pattern of bosses comprises a circle.

36. The method of claim 28, wherein each of the bosses of the pattern of bosses comprises an elongate curve.

37. The method of claim 28, wherein each of the bosses of the pattern of bosses comprises a generally longitudinal segment or a generally lateral segment.

38. The method of claim 28, wherein the construct comprises paperboard.

39. The method of claim 28, wherein the first planar surface of the panel surrounds the entire perimeter of the at least one emboss and the at least one deboss.

40. The method of claim 28, wherein the first planar surface abuts the emboss edge around the entire perimeter of the at least one emboss and the first planar surface abuts the deboss edge around the entire perimeter of the at least one deboss.

41. The method of claim 28, wherein the outer edge is one of a plurality of outer edges of the panel, the first planar surfaced extending to each of the plurality of outer edges of the panel.

42. A construct for supporting at least one article, the construct comprising:

at least a panel; and a plurality of stiffening features comprising a pattern of bosses formed in the panel, the pattern of bosses being configured for at least partially reducing buckling of the panel, the pattern of bosses comprising:

at least one emboss and at least one deboss, wherein the at least one emboss is spaced apart from the at least one deboss by a neutral area of the panel, the neutral area of the panel comprising a first planar surface extending between the at least one emboss and the at least one deboss and extending to an outer edge of the panel, the at least one emboss comprising an emboss edge extending around the at least one emboss and defining an emboss edge interior area, the emboss comprising an entirety of the emboss edge interior area, an entirety of an exterior of the emboss edge abutting the neutral area, and the at least one deboss comprising a deboss edge extending around the deboss and defining a deboss edge interior area, the deboss comprising an entirety of the deboss edge interior area, an entirety of an exterior of the deboss edge abutting the neutral area, the emboss edge extending from the first planar surface to a second planar surface in a first direction, the deboss edge extending from the first planar surface to a third planar surface in a second direction, and the second direction being opposite the first direction.

43. A method of forming a construct, the method comprising:

obtaining a web of material comprising at least a panel; and forming a plurality of stiffening features in the panel comprising forming a pattern of bosses in the panel for at least partially reducing buckling of the panel, the pattern of bosses comprising:

at least one emboss and at least one deboss, wherein the at least one emboss is spaced apart from the at least one deboss by a neutral area of the panel, the neutral area of the panel comprising a first planar surface extending between the at least one emboss and the at least one deboss and extending to an outer edge of the panel, the at least one emboss comprising an emboss edge extending around the emboss and defining an emboss edge interior area, the emboss comprising an entirety of the emboss edge interior area, and an entirety of an exterior of the emboss edge abutting the neutral area, and the at least one deboss comprising a deboss edge extending around the deboss and defining a deboss edge interior area, the deboss comprising an entirety of the deboss edge interior area, and an entirety of an exterior of the deboss edge abutting the neutral area, the emboss edge extending from the first planar surface to a second planar surface in a first direction, the deboss edge extending from the first planar surface to a third planar surface in a second direction, and the second direction being opposite the first direction.

* * * * *